US012808133B2

(12) United States Patent
Hamaguchi

(10) Patent No.: US 12,808,133 B2
(45) Date of Patent: Nov. 24, 2026

(54) ARTIFICIAL TURF, FILLER FOR ARTIFICIAL TURF, AND ARTIFICIAL TURF PRODUCTION METHOD

(71) Applicant: COOOL Co., Ltd., Munakata-city (JP)

(72) Inventor: Kouichirou Hamaguchi, Munakata-city (JP)

(73) Assignee: COOOL Co., Ltd. (JP)

( * ) Notice: Subject to any disclaimer, the term of this patent is extended or adjusted under 35 U.S.C. 154(b) by 484 days.

(21) Appl. No.: 17/772,936

(22) PCT Filed: Oct. 30, 2020

(86) PCT No.: PCT/JP2020/040947
§ 371 (c)(1),
(2) Date: Dec. 7, 2022

(87) PCT Pub. No.: WO2021/085634
PCT Pub. Date: May 6, 2021

(65) Prior Publication Data
US 2023/0136642 A1 May 4, 2023

(30) Foreign Application Priority Data
Nov. 1, 2019 (JP) ..... 2019-200330

(51) Int. Cl.
*E01C 13/08* (2006.01)

(52) U.S. Cl.
CPC ..... *E01C 13/08* (2013.01)

(58) Field of Classification Search
CPC ..... E01C 13/08; Y10T 428/23921
See application file for complete search history.

(56) References Cited

U.S. PATENT DOCUMENTS 10,059,836 B1 * 8/2018 Ha ..... B29C 48/022
2008/0274307 A1 * 11/2008 Chereau ..... B32B 7/12 428/17
2008/0299331 A1 * 12/2008 Gilardi ..... E01C 13/08 428/22
2012/0071597 A1 * 3/2012 Aerts ..... C09J 193/04 524/274
2012/0258811 A1 * 10/2012 Tetrault ..... C08J 3/24 252/78.3
2020/0165784 A1 * 5/2020 Noordegraaf ..... C08J 9/224
(Continued)

FOREIGN PATENT DOCUMENTS

CN 1446735 A * 10/2003 ..... C08J 9/30
EP 2039831 A1 * 3/2009 ..... E01C 13/08
(Continued)

OTHER PUBLICATIONS

JP 2011-084930 translation.*
(Continued)

*Primary Examiner* — Jenna L Johnson
(74) *Attorney, Agent, or Firm* — Smith, Gambrell & Russell, LLP

(57) ABSTRACT

An artificial turf can include a base material; a plurality of piles imitating turf leaves erected on the base material; and a filler layer formed by a filler material being filled between the plurality of piles, wherein the filler layer includes a water retaining layer and a mineral having calcium carbonate as a major component.

7 Claims, 3 Drawing Sheets

(56) References Cited

U.S. PATENT DOCUMENTS

| | | | | |
|---|---|---|---|---|
| 2021/0180270 | A1* | 6/2021 | Meherg | E01C 13/083 |
| 2022/0042252 | A1* | 2/2022 | Sick | E01C 13/08 |
| 2023/0374738 | A1* | 11/2023 | Sethunath | E01C 13/08 |
| 2024/0110342 | A1* | 4/2024 | Alampi | E01C 13/083 |
| 2024/0200282 | A1* | 6/2024 | Sick | E01C 13/08 |

FOREIGN PATENT DOCUMENTS

| | | | | |
|---|---|---|---|---|
| EP | 2206833 | A1 * | 7/2010 | B29B 7/7461 |
| EP | 3455409 | B1 * | 9/2020 | B32B 25/02 |
| EP | 3839142 | A1 * | 6/2021 | E01C 13/02 |
| EP | 3901370 | A1 * | 10/2021 | E01C 13/08 |
| FR | 2952075 | A1 * | 5/2011 | C09D 113/02 |
| JP | 2005281932 | A | 10/2005 | |
| JP | 2010159620 | A | 7/2010 | |
| JP | 2011084930 | A | 4/2011 | |
| JP | 2014111889 | A | 6/2014 | |
| JP | 2018123522 | A | 8/2018 | |
| JP | 2018178499 | A | 11/2018 | |
| KR | 20190085415 | A | 7/2019 | |
| WO | 2006109110 | | 10/2006 | |
| WO | 2018016956 | | 1/2018 | |

OTHER PUBLICATIONS

Moving towards a renewable world by Calcean.com, http://web.archive.org/web/20190529114343/http://www.calcean.com/page-p/, May 29, 2019.*

Agricultural Uses of Calcean.com, http://web.archive.org/web/20190529032257/http://www.calcean.com/agriculture/, May 29, 2019.*

CN 1202314 C English Translation and Foreign Publication. May 18, 2005 (Year: 2005).*

CN 1446735 English Translation. Oct. 8, 2003 (Year: 2003).*

Coool Co., Ltd.; Extended European Search Report for application No. 20882664.4, mailed Nov. 6, 2023, 9 pgs.

Hamaguchi, Kouichirou; International Preliminary Report on Patentability for PCT/JP2020/040947, filed Oct. 30, 2020, mailed Nov. 2, 2021, 8 pgs.

Hamaguchi, Kouichirou; International Search Report and Written Opinion for PCT/JP2020/040947, filed Oct. 30, 2020, mailed Dec. 28, 2020, 10 pgs.

* cited by examiner

PRIOR ART

ARTIFICIAL TURF, FILLER FOR ARTIFICIAL TURF, AND ARTIFICIAL TURF PRODUCTION METHOD

TECHNICAL FIELD

The present invention relates to artificial turf, artificial turf filler and artificial turf production method, and more particularly, to artificial turf, etc., comprising a filler layer with filler between a plurality of piles.

BACKGROUND ART

Artificial turf is currently used in various sports facilities. In addition, a variety of artificial turf has been developed. The following is a description of artificial turf commonly used in football grounds.

The natural turf used in the past required a lot of daily maintenance work, such as fertilization, watering and repair. In comparison, artificial turf is easy to maintain and manage. In addition, the use of artificial turf has been increasing in recent years because it is made of an organic polymer compound, which makes it highly durable and enables competitions to be played even after rain.

However, early artificial turf was hard and had poor shock-absorbing properties, which placed a heavy burden on the knees. In addition, there was a problem of burns and abrasions that could easily occur when sliding.

The history of the development of artificial turf is explained with reference to FIG. 2A, FIG. 2B and FIG. 2C. FIG. 2A, FIG. 2B and FIG. 2C show cross-sectional views of conventional artificial turfs. FIG. 2A shows the conventional artificial turf of first-generation. FIG. 2B shows the conventional artificial turf of second-generation. And FIG. 2C shows the conventional artificial turf of third-generation artificial turf.

Artificial turf was first introduced (first generation) in the world in 1966 at the Astrodome (baseball stadium) in Houston, USA. In Japan, it was introduced at Korakuen Stadium in 1976. As shown in FIG. 1A, the first-generation artificial turf 11 consists of a pile layer 13 and a cushioning layer 15 (synthetic polymer foam) called underpad to ensure the cushioning required for sports and has a two-layer structure. A number of piles 17 forming the pile layer 13 are raised from the cushion layer 15 in a carpet-like shape.

The first-generation artificial turf 11 was noted to have a safety problem in that it was prone to burns and abrasions when sliding. Furthermore, the underpads were locally indented due to their flexibility, making it difficult for players to stand on their feet when dashing or jumping, which was a problem that tended to cause strain on the player's feet and legs.

Due to the high safety and installation costs of the first-generation artificial turf 11, sand-filled artificial turf was introduced in the 1980s as the second-generation artificial turf 21. The second-generation artificial turf 21 consists of a pile layer 23, a cushion layer 25, a pile 27, and further with a sand 29 in between piles 27. In addition, the second-generation artificial turf 21 has a smaller number of piles 27 to be woven in than the first-generation artificial turf 11, and it has sand between the artificial turf 29, resulting in a cost that is said to be about 50% lower than first-generation artificial turf. As a result, it was widely used in baseball fields and tennis courts at the civic level. In addition, the second-generation artificial turf 21, with the addition of sand 29, reduced the localized denting of the underpad, as the impact received by the player's feet is transmitted downwards in a wider area and is mitigated. Therefore, the problem of fatigue in the player's feet and legs was improved.

However, another problem arose with the second-generation 21 artificial turf. When it was used for many years and the sand layer was hardened and tightened, it tended to transmit impact directly to the feet and knees during exercise.

In the late 1990s, third-generation artificial turf 31, commonly known as high-tech artificial turf, was introduced. The third-generation artificial turf 31 has a pile layer 33, a rubber chip layer 35, sand 37 and a base layer 39. The pile forming the pile layer 33 is a long pile 41, longer than the artificial turf of the first-generation artificial turf 11 and the second-generation artificial turf 21. The third-generation artificial turf 31 does not comprise the underpad. It has a base layer 39, a rubber chip layer 35 and a sand 37, which form three layers. The rubber chip layer 35 is cushioned and adjusted to be not too soft by adding sand 37. This makes the deformability during exercise closer to that of natural grass, thereby reducing injuries.

For example, Patent Document 1 describes a technology for improving the shock absorbency of artificial turf by filling rubber chips made from crushed waste tires, industrial waste, etc. as filler between a number of piles resembling turf leaves rising on a base material constituting the artificial turf.

PRIOR ART LITERATURE

Patent Document

Patent Document 1: Japanese Patent Publication No. 2018-178499.

SUMMARY OF THE INVENTION

Problem Solved by the Invention

However, when the inventor measured and compared the surface temperatures of natural and artificial turf under natural light, the surface temperature of conventional artificial turf was over 60° C., sometimes 20° C. higher than that of natural turf.

FIG. 3A and FIG. 3B show the isothermal distribution of surface temperatures of a ground with third-generation artificial turf and a ground with natural grass. FIG. 3A and FIG. 3B show the distribution of surface temperatures near noon on a sunny day in September.

Note that the wind was blowing from the east (right side of the figure), so the surface temperature is lower on the right side of the figure due to the wind. Overall, the surface temperature of the third-generation artificial turf was approximately 20° C. higher than that of the natural turf, with some areas exceeding 60° C.

Thus, there remained room for improvement in order to use artificial turf as a substitute for natural grass. It is therefore an object of the present invention to provide an artificial turf or the like with a function to maintain the temperature of the artificial turf surface at a low temperature.

Means for Solving the Problems

A first aspect of the present invention is an artificial turf comprising a base material, a plurality of piles imitating turf leaves erected on the base material, and a filler layer formed by a filler material being filled between the plurality of piles, wherein the filler layer includes a water retaining layer, and a mineral having calcium carbonate as a major component.

A second aspect of the present invention is the artificial turf of the first aspect, wherein the water retaining layer has a porous material.

A third aspect of the present invention is the artificial turf of the first or second aspect, wherein the filling material has a plant-derived material.

A fourth aspect of the present invention is the artificial turf of the third aspect, further comprising a mineral layer between the filler layer and the base material, wherein the mineral is the main material of the mineral layer.

A fifth aspect of the present invention is the artificial turf of the third or fourth aspect, wherein the mineral is limestone.

A sixth aspect of the present invention is the artificial turf of the fifth aspect, wherein the plant-derived material is wood chips and sawdust derived from bark.

A seventh aspect of the present invention is the artificial turf of the fifth aspect, wherein the plant-derived material is coconut pete.

An eighth aspect of the present invention is an artificial turf filler, which is filled between a plurality of piles resembling turf leaves in the artificial turf, comprising a plant-derived material, and a mineral comprising calcium carbonate as a major component.

A ninth aspect of the invention is an artificial turf production method comprising a base material and a plurality of piles resembling turf leaves erected on the base material, and wherein the filler material comprises a plant-derived material, and a mineral comprising calcium carbonate as a major component, and the artificial turf production method includes filling the filler material on the base material and between the plurality of piles.

Effect of the Invention

According to each aspect of the present invention, it is possible to deprive the minerals of a lot of vaporization heat as the water contained in the water retaining layer vaporizes, and also to delay the temperature rise by providing moisture to the minerals. This makes it possible to provide artificial turf and the like with the ability to maintain the temperature of the artificial turf surface at a low temperature. As a result, it is possible to provide artificial turf with a high level of safety by suppressing burns and heat stroke of users.

The rubber chips forming the rubber chip layer used in the third-generation artificial turf are recycled from finely crushed car tires. Tires contain various chemicals such as zinc oxide, sulfur, carbon black, etc. And some reports indicate that benzopyrene, which is considered to be highly carcinogenic, has been detected in the rubber chips. According to the third, eighth or ninth aspect of the present invention, only natural resources are used for the filling material, without using rubber chips, which may cause environmental pollution and risk to the health of the user. This makes it possible to suppress the adverse effects on the user's health.

According to the fourth aspect of the invention, the relatively cushiony filling material layer and the relatively hard mineral layer reduce the physical burden on the user and maintain an adequate resilience.

Furthermore, according to the fifth to seventh aspects of the present invention, it is possible to provide a more effective artificial turf.

DETAILED DESCRIPTION

Form for Carrying Out the Invention

The embodiments of the invention are described in detail below with reference to the drawings. The embodiments of the invention are not limited to those described below.

Example 1

Figure 1:
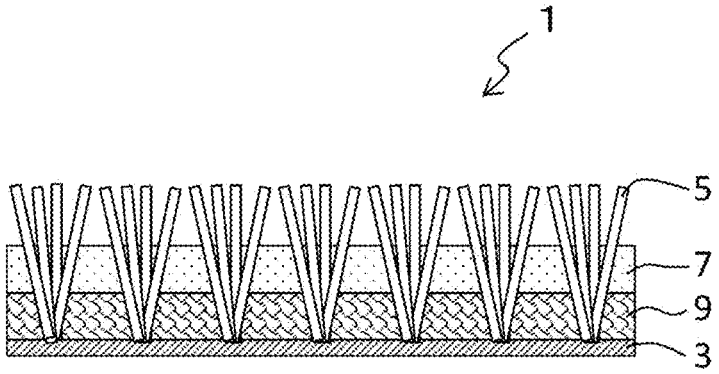
FIG. 1 is a cross-sectional view of the artificial turf of the present invention.
Figure 2A:
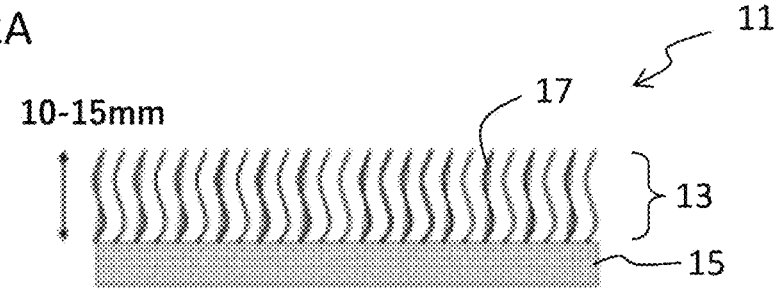
FIG. 2A is a cross-sectional view of conventional artificial turf, showing the first generation.
Figure 2B:
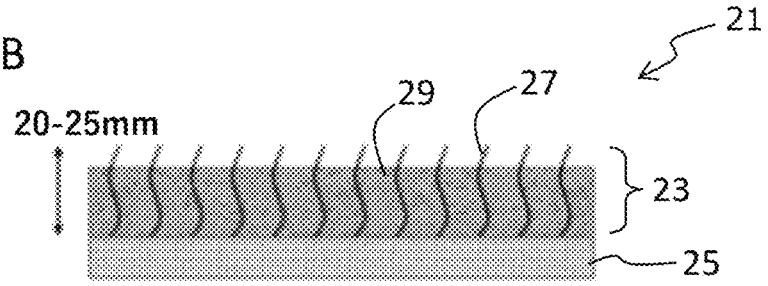
PRIOR ART FIG. 2B
FIG. 2B is a cross-sectional view of conventional artificial turf, showing the second generation.
Figure 2C:
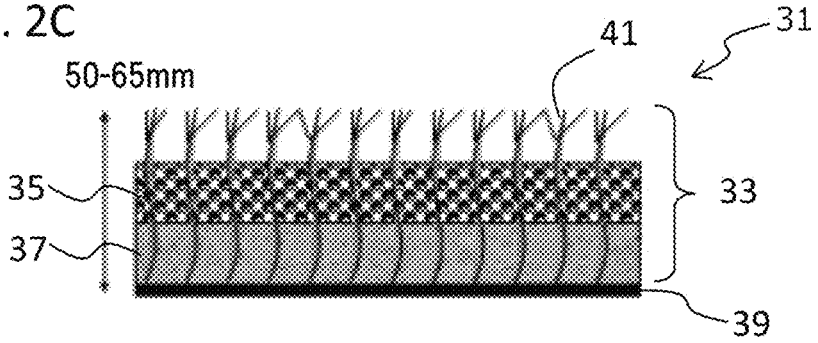
PRIOR ART FIG. 2C
FIG. 2C is a cross-sectional view of conventional artificial turf, showing the third-generation artificial turf.
Figure 3A:
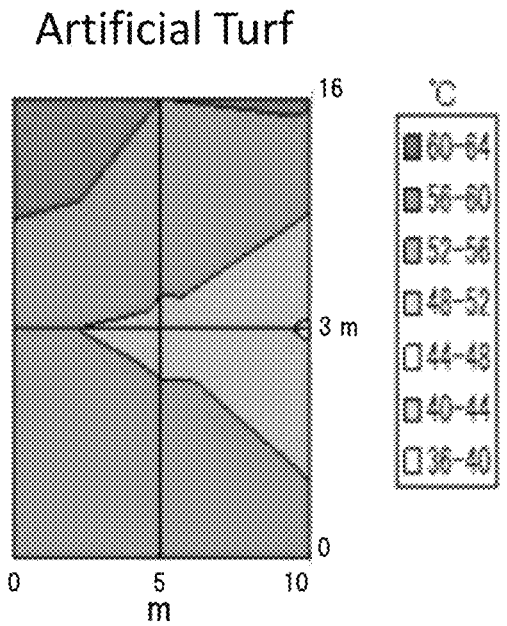
FIG. 3A and FIG. 3B are the isothermal distributions of surface temperatures of a ground with third-generation artificial turf and a ground with natural grass.
Figure 3B:
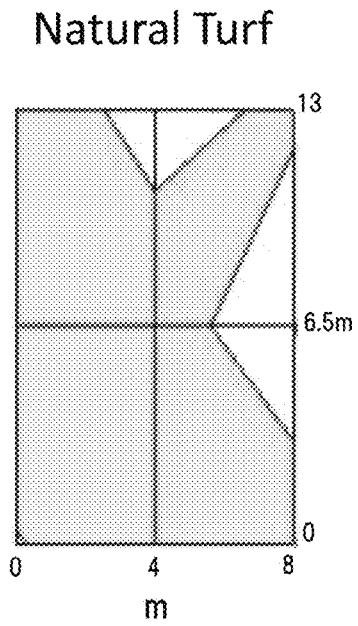

FIG. 1 shows a cross-sectional view of an artificial turf 1. The artificial turf 1 (an example of "artificial turf" in the present claims) comprises a base material 3 (an example of "base material" in the present claims), a number of piles 5 (an example of "pile" in the present claims) imitating turf leaves standing on the base material 3, a filler layer 7 (an example of a "water retaining layer" and a "filler layer" in the present claims) formed by filling the spaces between the numerous piles 5 with a filler material (an example of a "filler material" in the present claims), a mineral layer 9 (an example of a "mineral layer" in the present claims) made mainly of minerals (an example of a "mineral" in the present claims), being between the base material 3 and the filler layer 7.

The filler material forming the filler layer 7 includes a plant-derived material (an example of a "porous material" and a "plant-derived material" in the present claims) and a mineral mainly composed of calcium carbonate. For the plant-derived material, dried and powdered coconut pete was used. For the minerals, Kansuiseki stone from Mt Kawaradake in Iizuka, Fukuoka Prefecture, was used. Kansuiseki is a white crystalline limestone.

An artificial turf production method (an example of an "artificial turf production method" in the present claims) according to the present invention for producing an artificial turf 1 is as follows. The artificial turf 1 is produced through a pile planting step for planting a number of piles 5 on a substrate 3, a mineral layer formation step for forming a mineral layer 9 made mainly of minerals between a number of piles 5, and a filler layer forming step in which a filler layer 7 is formed by filling a filler material on top of the mineral layer 9 and between the numerous piles 5.

For example, the overall thickness of the pile 5 may be 40-60 mm, including the substrate 3 being a 5-15 mm shock pad, the mineral layer 9 being 10-15 mm, and the filler layer 7 being 15-30 mm and the length of the pile 5 above the filler layer 7 being 10-15 mm. The thickness of each of these layers and the overall thickness may be other than the above if necessary.

Fillers and minerals can be further added later if necessary.

A flexible shock pad is used as the base material 3, for example. Shock pads have a structure made of thread-like material and can retain a certain amount of water. Therefore, the water retaining layer may be realized by the base material 3 instead of a filler layer. Alternatively, the base material 3 may function as a water retaining layer together with the filler layer. The heat of vaporization of the moisture retained by the base material 3 can also be expected to cool the artificial turf, at least by the heat of vaporization.

The artificial turf 1 of the present invention has the same shock absorption, durability and ease of maintenance as conventional artificial turfs, and furthermore, the temperature rise of the artificial turf surface can be suppressed, thus providing players with a cooler and more comfortable environment.

Examples of actual measurement results comparing the surface temperature between the artificial turf of the present invention and the third-generation artificial turf are shown in Table 1. As shown in Table 1, the surface temperature of the artificial turf in this example is more stable than that of the third-generation artificial turf placed in the same environment and the temperature rise is suppressed by more than 10° C.

TABLE 1

| Measurement environment | Artificial turf of the present invention (° C.) | Third-generation artificial turf (° C.) |
|---|---|---|
| 1 | 36.9 | 48.6 |
| 2 | 35.0 | 49.1 |
| 3 | 43.8 | 60.1 |

Here, the above surface temperature measurements were made using a non-contact thermometer, which measured the radiant temperature. It is expected that the sport players who is in direct contact with the artificial turf will feel even cooler on the artificial turf of the present example.

In addition, because coconut pete is used instead of rubber chips to enhance shock absorption, there is no risk of environmental pollution or health hazards.

Although powdered coconut pete was used as the plant-derived material, bark chips from cypress, cedar and other trees may also be used. By replacing the filling material with bark chips instead of rubber chips, the higher surface temperature can be suppressed. Wood chips and/or sawdust from crushed bark may also be used as a plant-derived material, or a mixture with coconut peat may be used.

Black rubber chips, which are recycled tire material, tend to produce black carbon particles and produce an unpleasant odor when the temperature rises. On the other hand, cypress and cedar bark chips give off a woody aroma and a pleasant feeling of forest bathing. Furthermore, bark chips are superior to rubber chips in terms of resource recycling.

Powdered coffee beans may also be used as a plant-derived material.

DESCRIPTION OF THE REFERENCE NUMBERS (1) artificial turf, (3) base material, (5) pile, (7) filler layer, (9) mineral layer, (11) first-generation artificial turf, (13) pile layer, (15) cushion layer, (17) pile, (21) second-generation artificial turf, (23) pile layer, (25) cushion layer, (27) pile, (29) sand, (31) third-generation artificial turf, (33) pile layer, (35) rubber chip layer, (37) sand, (39) substrate layer, (41) long pile.

The invention claimed is:

1. An artificial turf comprising:
a base material;
a plurality of piles imitating turf leaves erected on the base material; and
a filler layer formed by a filler material being filled between the plurality of piles,
wherein the filler layer includes:
a plant-derived material, the plant-derived material including a porous material; and
a mineral-based material having calcium carbonate as a major component, the mineral-based material being limestone;
and
wherein the artificial turf further comprises a mineral layer between the filler layer and the base material, the mineral layer mainly comprising a second mineral-based material having calcium carbonate as a major component.

2. The artificial turf according to claim 1, wherein the plant-derived material is wood chips and sawdust derived from bark.

3. The artificial turf according to claim 1, wherein the plant-derived material is coconut pete.

4. A method of producing artificial turf,
wherein:
the artificial turf comprises a base material, a plurality of piles resembling turf leaves erected on the base material, and a filler layer comprising a filler material; the filler material comprising:
a plant-derived material, the plant-derived material including a porous material; and
a mineral-based material comprising calcium carbonate as a major component, the mineral-based material being limestone; and
the artificial turf production method includes:
filling the filler material on the base material and between the plurality of piles.

5. An artificial turf comprising:
a base material;
a plurality of piles imitating turf leaves erected on the base material; and
a filler layer formed by a filler material being filled between the plurality of piles,
wherein the filler layer includes:
a plant-derived material, the plant-derived material including a porous material; and
a mineral-based material having calcium carbonate as a major component; and
wherein the mineral-based material is limestone.

6. The artificial turf according to claim 5, wherein the plant-derived material is wood chips and sawdust derived from bark.

7. The artificial turf according to claim 5, wherein the plant-derived material is coconut pete.

* * * * *